United States Patent [19]

Lucas, Jr

[11] 4,022,360

[45] May 10, 1977

[54] ADJUSTABLE LOCKING DEVICE FOR PANTS HANGERS AND SKIRT HANGERS

[76] Inventor: Frederic C. Lucas, Jr, 4250 Middlesex Drive, San Diego, Calif. 92116

[22] Filed: Mar. 29, 1976

[21] Appl. No.: 671,500

[52] U.S. Cl. ..... 223/96; 211/89

[51] Int. Cl.[2] ..... A47J 51/14

[58] Field of Search ..... 223/90, 91, 93, 96; 211/89, 124

[56] References Cited

UNITED STATES PATENTS

| | | | |
|---|---|---|---|
| 543,403 | 7/1895 | Ronner | 223/91 |
| 1,111,476 | 9/1914 | Locke | 223/96 X |
| 1,143,693 | 6/1915 | Down | 211/89 |
| 1,260,451 | 3/1918 | Reed | 223/96 X |
| 1,529,128 | 3/1925 | Hartwig | 223/91 X |
| 2,825,468 | 3/1958 | Watkins | 223/96 X |

*Primary Examiner*—George H. Krizmanich

[57] ABSTRACT

A simple adjustable locking device, utilizing a screw and wing nut, which may be easily installed by the owner of the common pants or skirt hangers employing two wooden gripping members in order to correct deficiencies in those hangers caused by distortion of the original locking mechanism, or by differences in thickness and width of the various garments to be hung.

1 Claim, 6 Drawing Figures

ADJUSTABLE LOCKING DEVICE FOR PANTS HANGERS AND SKIRT HANGERS

BRIEF SUMMARY OF THE INVENTION

This invention relates to a simple device to correct deficiencies in pants and skirt hangers in current use.

The most common type of pants and skirt hanger in use in the home is that which consists of a pair of parallel wooden bars, hereinafter referred to as the "wooden gripping members", supported by an arrangement of metal rods so formed as to provide the hinge, the clamping mechanism and a hook for hanging the garment. There are many thousands of such hangers in use which do not support the garment firmly and evenly due to one or more of the following factors:

1. There is a wide variation in the thickness of materials.
2. Pants are made with and without cuffs and with welted or flat seams.
3. Current styles have a wide variation in the width of the bottom of the trouser leg.
4. Clamping mechanisms become distorted after use on the thicker materials.

There is a definite need for a simple device to improve the effectiveness of these hangers. In order to be economically practicable, such a device must be very inexpensive and so designed that it may be installed by a person of ordinary mechanical ability with readily available tools.

This invention provides a simple screw and wing nut device to be mounted near each end of the wooden gripping members of the pants or skirt hanger. This device permits the proper amount of compression to be applied to hold the garment firmly regardless of its thickness. Furthermore, by transferring the pressure points to the extremities of the gripping members, it allows the hanger to hold wider garments more evenly. In addition, the device will generally permit the hanging of two or more garments securely on a single hanger as may be desired for seasonal storage to conserve hanging space.

BRIEF DESCRIPTION OF THE INVENTION

The invention requires installation of a device near each end of the hanger's wooden gripping members.

DETAILED DESCRIPTION OF THE INVENTION

Figure 1:
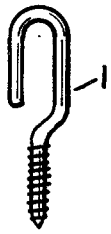
FIGS. 1 and 2 show details of the parts of this device.

FIG. 1 shows details of the U-screw 1 which is formed from screw stock or similar material. It has wood screw threads at the lower end and the upper part is shaped into an inverted U as shown.

Figure 2:
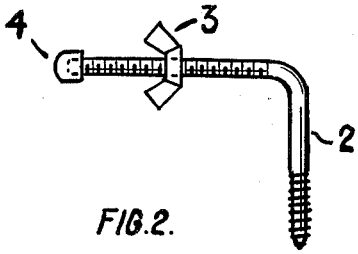

FIG. 2 shows details of the right-angle screw 2 which is also formed of screw stock or similar material. One arm has wood screw threads. The other arm has machine screw threads and carries a wing nut 3. A small plastic cap 4 has been fitted over the end of this arm. This cap, the purpose of which is to prevent the wing nut from being inadvertantly backed off the screw, and to prevent possible damage to adjacent garments while hanging, has been omitted from the assembly views for the sake of clarity.

Figure 3:
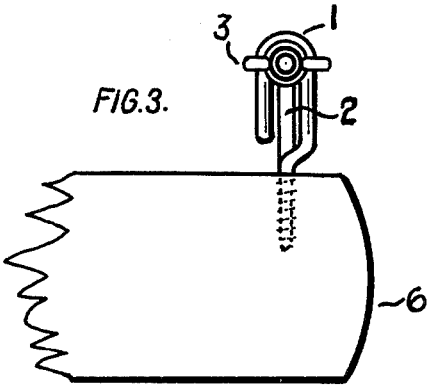
FIGS. 3 and 4 are front and side assembly views of the device installed, with the hanger in the closed position. Only one end of the hanger is shown since the installation at the other end is identical.
Figure 4:
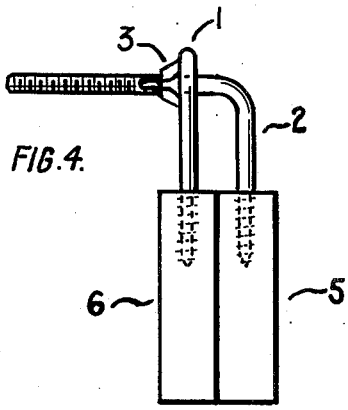

In FIGS. 3 and 4 it can be seen that one arm of the right-angle screw 2 has been screwed perpendicularly into the top surface of the rear gripping member 5 at the center line, with the other arm, carrying the wing nut 3, extending across the front gripping member 6 perpendicular to the gripping surface. The U-screw 1 has been screwed perpendicularly into the top surface of the front gripping member 6 on the center line at a point directly opposite the right angle screw 2 so that the arm carrying the wing nut passes through the opening in the U-screw 1 near its upper end when the hanger is closed.

Figure 5:
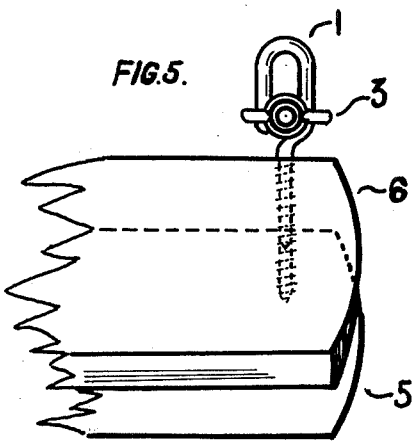
FIGS. 5 and 6 are front and side views of the assembly with the hanger in the open position.
Figure 6:
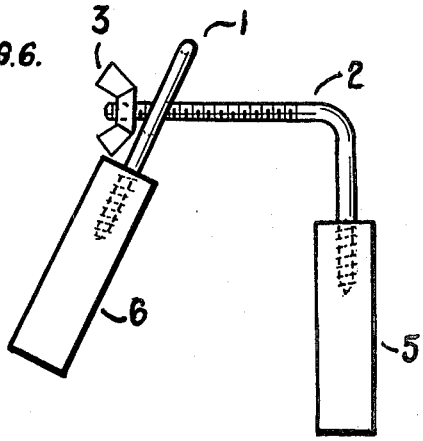

FIGS. 5 and 6 are front and side views of the assembly with the hanger in the open position. It will be noted that the elongated shape of the U-screw 1 accommodates its movement relative to the arm of the right angle screw 2, thus allowing the hanger to be opened sufficiently to insert the garment when the wing nut 3 is backed off to a point near the end of the screw.

Installation of the device requires the drilling of four pilot holes per hanger in the wooden gripping members but no tools other than the drill. It is therefore easily accomplished by the average owner of unsatisfactory hangers.

The operation of the device is as follows:

With the hanger in the open position the appropriate part of the garment is fitted between the gripping members. By closing the original locking mechanism, or by pressure exerted by one hand, the garment is held in position while the wing nuts are spun to the position where they begin to exert pressure. At this point the garment may be adjusted to hang evenly, and then firmly gripped by a few more turns of the wing nuts. The garment can be released by a few turns of the wing nuts. Operation of the wing nuts, except while they are exerting pressure, may be done with a few flicks of the index finger so the whole procedure requires only a few seconds.

There are embodiments of this invention other than that described above which are considered to be within the scope of this invention. The above described embodiment is considered to be the preferred embodiment because of its low cost and ease of installation.

I claim as my invention;

1. An adjustable locking device for clamping a pair of wooden gripping members of a conventional clamping hinged pants hanger comprising: a first metal rod having two arms disposed at 90° to each other with the ends thereof threaded, one arm being secured in the top surface of one end of one of said gripping members and the other arm threadably carrying a wing nut and extending across the end of the other of said gripping members, a second metal rod having a threaded end secured in the top surface of the other of said gripping members, the other end of said second metal rod formed into an inverted U providing a vertically elongated opening receiving the other arm of said first metal rod, said wing nut bearing about the opening releasably clamping said pair of gripping members together.

* * * * *